United States Patent [19]

Lafferty, Sr.

[11] 4,023,001

[45] May 10, 1977

[54] LOCKING MEMBER FOR HAND-HELD TRIGGER ACTUATED SWITCH

[75] Inventor: Gary S. Lafferty, Sr., Franklin, Wis.

[73] Assignee: Milwaukee Electric Tool Corporation, Brookfield, Wis.

[22] Filed: Sept. 2, 1975

[21] Appl. No.: 609,242

[52] U.S. Cl. ..... 200/157; 74/527; 200/321

[51] Int. Cl.[2] ..... H01H 9/06

[58] Field of Search ..... 200/157, 321; 74/527, 74/529, 531, 532, 536, 537, 538

[56] References Cited

UNITED STATES PATENTS

| | | | |
|---|---|---|---|
| 2,200,322 | 5/1940 | Arnesen | 128/303.14 |
| 2,237,646 | 4/1941 | Wilhide | 200/157 X |
| 2,450,380 | 9/1948 | Perham | 200/157 X |

*Primary Examiner*—Robert K. Schaefer
*Assistant Examiner*—Morris Ginsburg
*Attorney, Agent, or Firm*—John W. Michael; Gerrit D. Foster; Richard H. Bradford

[57] ABSTRACT

A portable electric tool has an ON-OFF trigger operated switch and a locking member to hold the trigger with the switch in ON position. The trigger has one end pivoted in the handle of the tool. A portion of the trigger extends outwardly from an opening in the handle so that it can be manually moved inwardly to ON position by the operator while holding the tool by its handle. Such inward movement is resiliently resisted and the ON position is momentary so that when the operator releases actuating pressure, the trigger automatically moves to switch OFF position.

4 Claims, 7 Drawing Figures

LOCKING MEMBER FOR HAND-HELD TRIGGER ACTUATED SWITCH

BACKGROUND OF THE INVENTION

1. Field of the Invention

This invention relates to the locking of the trigger for a momentary switch (sometimes called "dead man" switch) in the ON position. The object of this invention is to provide a locking member which is located centrally of the trigger and adjacent to a swinging end of such trigger. This makes the device equally usable by both right and left handed operators. A further object is to provide a locking member the operating arm of which does not protrude substantially so as to be easily damaged.

2. Description of the Prior Art

In expired U.S. Pat No. 2,200,322, there is described a locking member 30 which locks the trigger 55 of a cautery handle in ON position. The locking member is not biased to non-locking position. Consequently, the operator must perform a second manual manipulation to unlock the trigger from ON position. The locking member 30 has projecting top 60 which is centrally located with respect to the trigger 55 (see FIG. 2). It is so far removed below trigger 55 that the operator cannot operate the tool 60 with the fingers of the same hand that holds the pistol-like grip and also holds the trigger 55 in ON position. The same problems appear to be present in expired U.S. Pat. No. 2,237,646, where the unlocking of the locking member 49 (swinging loop) is the force of gravity. Furthermore, the loop 49 is greatly exposed and easily damaged.

A patentability search did not uncover any patents disclosing the features of the locking member: (1) being inherently biased to unlocking position; (2) being positioned centrally of an adjacent the free end of the swinging trigger; and (3) the ratio between the length of the operating arm and the length of the locking projection on the locking member being such that a small movement of such arm creates a large movement of the locking projection.

SUMMARY OF THE INVENTION

This invention is directed to a locking member for a spring biased pivoted trigger for a switch on a portable electric tool. When the trigger is unlocked, it is manually momentarily held in ON position. The locking member automatically moves from trigger locked to trigger unlocked position. The protruding surface of the locking member is positioned centrally of and adjacent the free swinging end of the trigger. The amount of movement of such part required to effect the locking of the trigger in ON position is slight. The automatic unlocking of the locking member is a safety feature. The locking member is easily moved to trigger locking position and is protected from destruction in ordinary usage of the tool.

BRIEF DESCRIPTION OF THE DRAWINGS

FIG. 7 is an enlarged sectional view taken on the line 7—7 of FIG. 2.

DESCRIPTION OF THE PREFERRED EMBODIMENT

Figure 2:
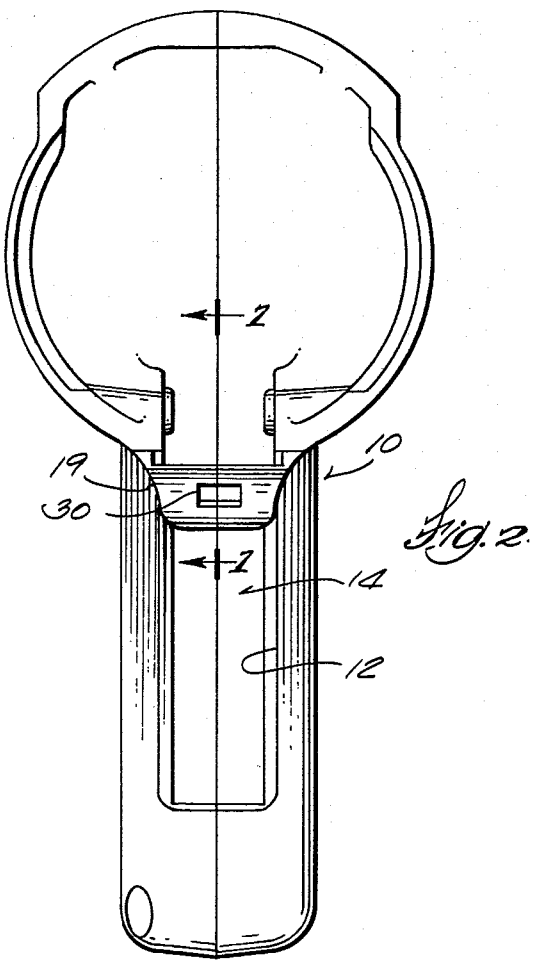
FIG. 2 is a view in end elevation of the projecting parts of the trigger and trigger locking member showing the centrally alligned relative positions.

Referring to the drawings by reference numerals the invention, for illustration purposes, is shown installed in the pistol grip handle 10 of a portable electric power drill. Since the electric motor, the switch for controlling it and the gear casing and output mechanism are well-known components not essential to an understanding of the present invention, they are not shown or described.

Figure 1:
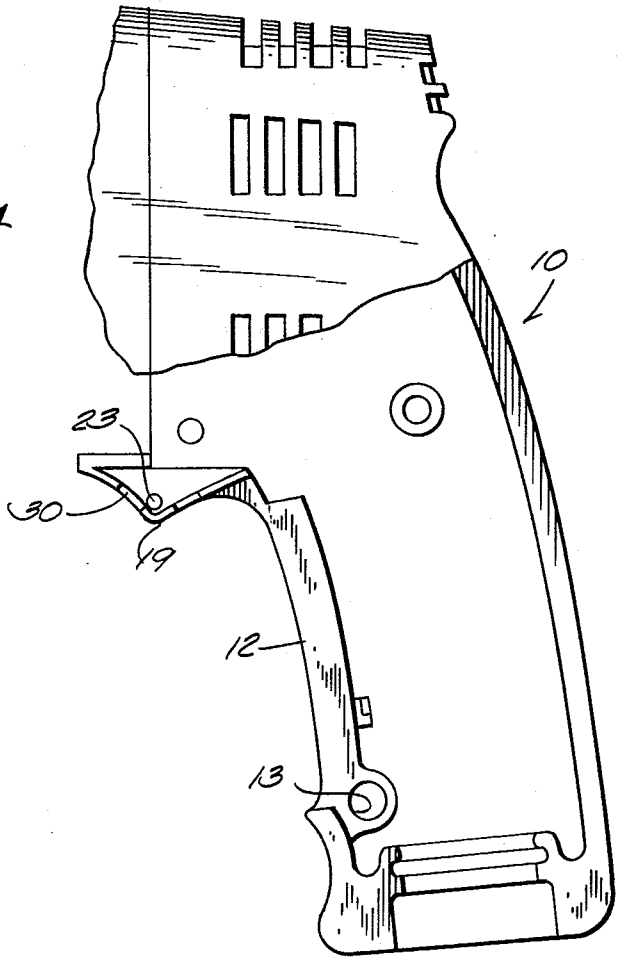
FIG. 1 is a view partly in side elevation and partly in section of the pistol handle of a portable tool in which handle is mounted the trigger and trigger locking member embodying the present invention.
Figure 3:
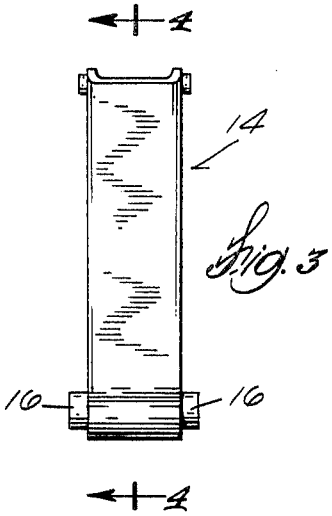
FIG. 3 is a view in front elevation of the switch trigger.
Figure 4:
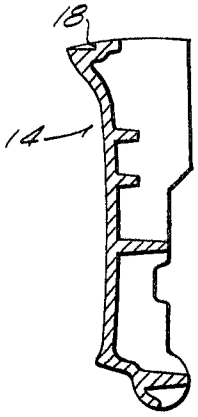
FIG. 4 is a sectional view taken on the line 4—4 of FIG. 3 to show the shoulder on the free swinging end of the trigger which is engaged by the trigger locking member.

As shown in FIG. 2, the pistol grip 10 has a trigger receiving opening 12. Shown in FIG. 1 are bearing openings 13 in which the lower end of the trigger 14 is pivotally mounted by pivot hubs 16 (see FIG. 3). The upper end of the trigger being freely swingable within controlled limits. Another well-known conventional feature is a compression spring (not shown) which biases the trigger outwardly to switch OFF position until stopped by an overhanging abutment 19 (see FIGS. 1 and 7). The upper free swinging end of the trigger 14 has an outward facing locking face 18 (see FIGS. 4 and 7) which is engaged by the locking member 20 as hereinafter described.

Figure 5:
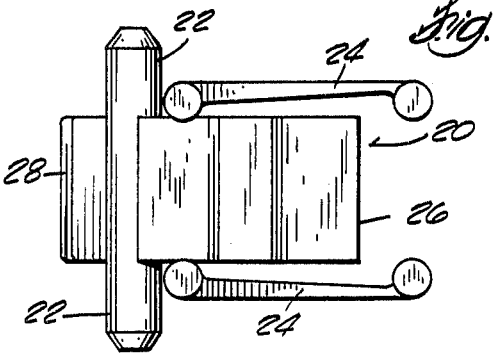
FIG. 5 is a top plan view of the trigger locking member showing the integral spring fingers inherently biasing the locking member to unlocked position.
Figure 2:
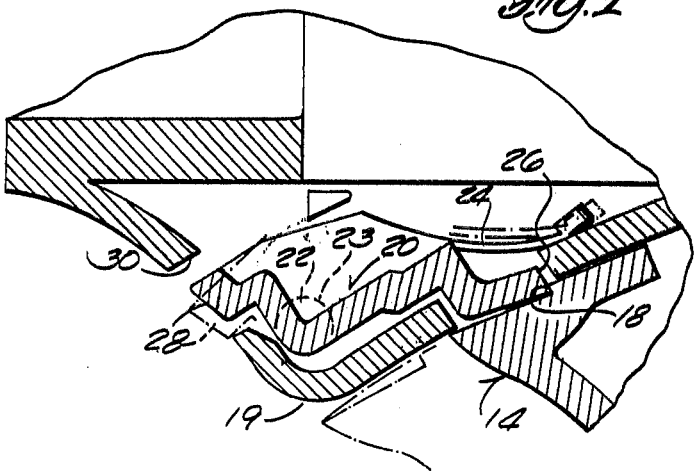
Figure 6:
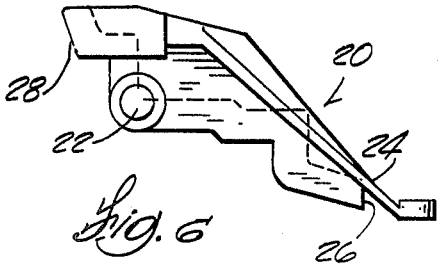
FIG. 6 is a view in side elevation of the locking member shown in FIG. 5.

The locking member 20 shown in detail in FIGS. 5 and 6 is pivotally mounted by pivots 22 rotably seated in openings 23 formed in opposing sides of the overhanging abutment 19 (see FIGS. 1 and 7). When the trigger 14 is manually moved inwardly to ON position, a protruding portion 28 on the locking member 20 is pressed inwardly by the operator to flex integral biasing fingers 24 and bring an inwardly facing face 26 into engagement with the outwardly facing face 18 so that as manual pressure is removed from the trigger 14, it will remain locked in ON position, the frictional engagement between faces 26 and 18 caused by the compression spring outwardly biasing the trigger is sufficient to normally maintain them in such engagement. It may be desirable to slightly slope (see FIG. 7) such engaging faces to provide a tooth-like lock therebetween. When inward pressure is again applied to the trigger 14, the faces 18 and 26 will be disengaged and the inherent resiliency in the fingers 24 will cause the locking member 20 to spring back into and remain in unlocking position so that the trigger 14 may be freely manipulated to and from ON and OFF positions.

A feature of the locking member 20 is that the radial distance from the axis of pivots 22 to the protruding surface 28 is much shorter than the radial distance from such axis to the locking face 26 so that a small inward swinging movement of the surface 28 will cause a much greater swinging movement of the locking face 26. This permits the projection of the surface 28 from the face at the overhang 19 to be set at a minimal distance from the outer surface of slot 30 in such overhang through which it projects. This minimal projection assures that in normal handling of the tool the projection portion 28 of the locking member will not be hit so as to damage it or the locking member 20.

I claim:

1. The combination for the control of a portable electric tool comprising:

a. a pistol grip handle for said tool;

b. an ON and OFF trigger pivoted at one end in said handle and biased to OFF position, said trigger having a freely swingable non-pivoted end, said trigger having an outwardly facing face on and movable with said non-pivoted end; and c. a spring biased pivotally mounted locking member supported independently of said trigger for locking said trigger in ON position, said locking member being positioned centrally of said trigger and said non-pivoted end and having an inwardly facing face.

2. The combination as claimed in claim 1 in which said locking member is mounted for swinging movement and has rearwardly projecting integral and resiliently flexible fingers engageable with said handle to bias said locking member to non-trigger locking position.

3. The combination as claimed in claim 1 in which said inwardly facing face of said locking member engages with said outwardly facing face to maintain said trigger in ON position.

4. The combination as claimed in claim 1 in which said locking member has a pivoted mounting and a protruding surface and the radial distance from the axis of said pivoted mounting to said protruding surface is substantially less than the radial distance from said axis to said inwardly facing face.

* * * * *